US010524630B2

(12) United States Patent
Chao

(10) Patent No.: US 10,524,630 B2
(45) Date of Patent: Jan. 7, 2020

(54) AUTOMATIC CLEANING MACHINE

(71) Applicant: Hobot Technology Inc., Chupei, Hsinchu County (TW)

(72) Inventor: Chi-Mou Chao, Chupei (TW)

(73) Assignee: HOBOT TECHNOLOGY INC., Chupei, Hsinchu County (TW)

( * ) Notice: Subject to any disclaimer, the term of this patent is extended or adjusted under 35 U.S.C. 154(b) by 96 days.

(21) Appl. No.: 15/837,822

(22) Filed: Dec. 11, 2017

(65) Prior Publication Data

US 2018/0098678 A1 Apr. 12, 2018

Related U.S. Application Data

(63) Continuation of application No. 15/297,427, filed on Oct. 19, 2016, now Pat. No. 9,968,234.

(30) Foreign Application Priority Data

Jun. 15, 2016 (TW) ..... 105118692 A
Jul. 21, 2016 (TW) ..... 105123054 A

(51) Int. Cl.
*A47L 11/40* (2006.01)
*A47L 11/30* (2006.01)
*A47L 11/24* (2006.01)

(52) U.S. Cl.
CPC ..... *A47L 11/4011* (2013.01); *A47L 11/24* (2013.01); *A47L 11/305* (2013.01); *A47L 11/4027* (2013.01); *A47L 11/4038* (2013.01); *A47L 11/4041* (2013.01); *A47L 11/4061* (2013.01); *A47L 11/4083* (2013.01); *A47L 11/4088* (2013.01); *A47L 2201/00* (2013.01); *A47L 2201/04* (2013.01)

(58) Field of Classification Search
CPC .... A47L 11/4011; A47L 11/24; A47L 11/305; A47L 11/4027; A47L 11/4038; A47L 11/4041; A47L 11/4061; A47L 11/4083; A47L 11/4088; A47L 2201/00; A47L 2201/04
See application file for complete search history.

(56) References Cited

U.S. PATENT DOCUMENTS 7,013,528 B2 3/2006 Parker
7,320,149 B1 1/2008 Huffman
(Continued)

FOREIGN PATENT DOCUMENTS

CN 201001696 Y 1/2008
CN 103356128 A 10/2013
(Continued)

OTHER PUBLICATIONS

Chinese Office Action based on corresponding Application No. 201610609185.5, issued Jun. 28, 2019.
(Continued)

*Primary Examiner* — Dung Van Nguyen
(74) *Attorney, Agent, or Firm* — Muncy, Geissler, Olds & Lowe, PC

(57) ABSTRACT

An automatic cleaning machines comprises a high-speed reciprocating cleaning means making a cleaning cloth reciprocatingly wipe a floor at high speed and a vacuum device sucking the dust in front of the cleaning cloth.

24 Claims, 7 Drawing Sheets

(56) References Cited

U.S. PATENT DOCUMENTS

| | | | | |
|---|---|---|---|---|
| 7,346,428 | B1 * | 3/2008 | Huffman | A47L 11/24 318/568.1 |
| 8,307,838 | B1 | 11/2012 | Hubbard | |
| 8,387,193 | B2 * | 3/2013 | Ziegler | A47L 5/14 15/50.1 |
| 8,898,844 | B1 | 12/2014 | Dooley | |
| 8,961,695 | B2 * | 2/2015 | Romanov | A47L 11/4011 134/18 |
| 9,615,712 | B2 | 4/2017 | Dooley | |
| 9,725,012 | B2 * | 8/2017 | Romanov | B60L 3/106 |
| 9,725,013 | B2 * | 8/2017 | Romanov | B60L 50/66 |
| 2003/0172480 | A1 | 9/2003 | Ueda et al. | |
| 2005/0015913 | A1 * | 1/2005 | Kim | A47L 5/30 15/319 |
| 2006/0185690 | A1 | 8/2006 | Song | |
| 2006/0288519 | A1 | 12/2006 | Jaworski | |
| 2014/0130289 | A1 * | 5/2014 | Hyun | A47L 11/145 15/319 |
| 2014/0373302 | A1 | 12/2014 | Hsu | |
| 2014/0373304 | A1 | 12/2014 | Haan | |
| 2015/0026920 | A1 | 1/2015 | Hsu | |
| 2015/0128996 | A1 * | 5/2015 | Dooley | A47L 11/125 134/6 |

FOREIGN PATENT DOCUMENTS

| | | | |
|---|---|---|---|
| CN | 103799924 | A | 5/2014 |
| CN | 204363897 | U | 6/2015 |
| CN | 204500545 | U | 7/2015 |
| CN | 205094334 | U | 3/2016 |
| CN | 205148310 | U | 4/2016 |
| CN | 205338850 | U | 6/2016 |
| JP | U1993035053 | | 5/1993 |
| JP | 2003-265384 | | 9/2003 |
| JP | A2013017686 | | 1/2013 |
| JP | A 2015058131 | | 9/2013 |
| JP | A2016077855 | | 1/2015 |
| KR | 2004-38294 | Y1 | 1/2008 |
| KR | 20110040357 | A | 4/2011 |
| KR | 10-2012-0088314 | | 8/2012 |
| KR | 102006105830 | A | 10/2016 |
| TW | M435906 | U1 | 8/2012 |
| WO | WO-2015/137563 | A1 | 9/2015 |
| WO | WO-2015/163375 | | 10/2015 |
| WO | WO-2017/121360 | A1 | 7/2017 |

OTHER PUBLICATIONS

Extended European Search Report based on corresponding Application No. 16201565.5—1712, dated May 24, 2017.

Korean Office Action based on corresponding Application No. 10-2017-0072385, dated Nov. 20, 2018.

Russian Office Action and Search Report based on corresponding Application No. 2017106797/12(011762), dated Dec. 21, 2018.

Taiwanese Office Action and Search Report based on corresponding Application No. 105123054, dated Apr. 18, 2018.

Japanese Office Action based on corresponding Reexamination Application No. 2017-093217, dated Aug. 30, 2019.

Japanese Final Office Action based on corresponding Application No. 2017-093127, dated Mar. 5, 2019.

Japanese Office Action based on corresponding Application No. 2017-093127, dated Jul. 31, 2018.

* cited by examiner

AUTOMATIC CLEANING MACHINE

CROSS-REFERENCE TO RELATED APPLICATIONS

This application is a Continuation of co-pending application Ser. No. 15/297,427 filed on Oct. 19, 2016, for which priority is claimed under 35 U.S.C. § 120; and this application claims priority of Application Nos. 105118692 filed in Taiwan, R.O.C. on Jun. 15, 2016 and 105123054 filed in Taiwan, R.O.C. on Jul. 21, 2016 under 35 U.S.C. § 119; the entire contents of all of which are hereby incorporated by reference.

BACKGROUND OF THE INVENTION

Field of the Invention

The present invention relates to an automatic cleaning machine, and more particularly to an automatic cleaning machine having a reciprocately wiping mechanism.

Related Art

Currently, a commercially available sweeping cleaning robot is mainly to remove dust. It usually includes a side brush and a vacuum suction port, and may further include a center brush or a cleaning cloth for mopping. However, since the cleaning cloth is just pulled by the robot, the effect of cleaning stain marks, footprints and fine particles is limited.

A commercially available washing robot (such as iRobot Scooba) is developed which sprays water onto a floor, which brushes the floor by a center brush and then recycles the water by a rubber scraper. Its disadvantage is that the water will be left on the floor when the floor is not even. The robot cannot be effectively used if the floor has slots.

A commercially available mopping robot (such as Mint's floor cleaner) is developed which pulls a cleaning cloth and moves back and forth to mop the floor. Its disadvantage is that the dust will be accumulated in front of the cleaning cloth and cannot be collected in the robot. Its cleaning effect is limited since the wipe frequency is low.

There is a need to develop an improved cleaning robot which can improve the above disadvantages of conventional robots.

SUMMARY OF THE INVENTION

It is an objective of an embodiment of the present invention to provide an automatic cleaning machine comprising a reciprocately wiping mechanism for reciprocately wiping a floor; a travelling device for moving the machine; and a control system and a plurality of sensors for detecting an obstacle and detecting the distance from the surrounding environment, so as to establish a map for planning a cleaning path. In an embodiment, the automatic cleaning machine further comprises a vacuum device used for sucking the dust in front of the cleaning cloth on the floor. In an embodiment, the automatic cleaning machine further comprises a spray device used for spraying water on the floor.

According to an embodiment of the present invention, an automatic cleaning machine comprises a reciprocately wiping mechanism, a travelling device and a control system. The reciprocately wiping mechanism comprises the at least one cleaning device and the at least one reciprocating device. The at least one cleaning device is used for being in contact with a floor. The at least one reciprocating device is connected to the at least one cleaning device and makes the at least one cleaning device reciprocately wipe the floor. The travelling device is used to make the automatic cleaning machine travel on the floor. The control system is coupled to the reciprocately wiping mechanism and the travelling device and is used to control the reciprocately wiping mechanism and the travelling device.

In an embodiment, the at least one cleaning device comprises a first cleaning device and a second cleaning device. The at least one reciprocating device is used to make the first cleaning device move in a first direction and make the second cleaning device move in a second direction opposite to the first direction.

In an embodiment, the automatic cleaning machine further comprises an housing. The housing is used for accommodating the at least one reciprocating device of the reciprocately wiping mechanism, the control system and the travelling device. The at least one cleaning device comprises a brush plate, a roller and a cleaning cloth. The brush plate is disposed below a base of the housing. The roller is located between the brush plate and the housing, and rotates on the brush plate or the base, so as to reduce the frictional resistance to the relative motion of the brush plate and the base. The cleaning cloth is disposed at the brush plate and used to be in contact with the floor.

In an embodiment, the automatic cleaning machine further comprises a housing and an elastic element. The housing is used for accommodating the at least one reciprocating device of the reciprocately wiping mechanism, the control system and the travelling device. The elastic element is disposed between the travelling device and the housing, so that the elastic element is capable of pushing the travelling device in a direction away from the automatic cleaning machine.

In an embodiment, the automatic cleaning machine further comprises a vacuum device. The vacuum device comprises an inlet. The dust on the floor is sucked into the inlet by an air flow. The at least one cleaning device comprises a first cleaning device. The inlet is disposed in front of the first cleaning device within a predetermined distance from the first cleaning device, wherein within the predetermined distance, the dust is not accumulated.

In an embodiment, the automatic cleaning machine further comprises a spray device used for spraying water on the floor.

In an embodiment, the travelling device comprises a moving wheel module and a case. The case accommodates the moving wheel module and includes a sleeve. The housing comprises a base, a fixing column, a ring stop and a fixing screw. The fixing column is disposed on the base and projects from the base. The sleeve is sleeved on the outer circumferential surface of the fixing column. The ring stop is disposed at a top side of the fixing column. The fixing screw is screwed into the fixing column, so that the ring stop is fixed at the top side of the fixing column. The end of the elastic element is abutted against the ring stop, and another end of the elastic element is abutted against a portion of the case of the travelling device.

In an embodiment, the at least one reciprocating device comprises a motor, a crankshaft, at least one crank. The crankshaft is driven by the motor to rotate. An end of the at least one crank is connected to the crankshaft, and another end of the at least one crank is connected to a brush plate of the at least one cleaning device and then reciprocately moves as the crankshaft rotates.

In an embodiment, the inlet of the vacuum device is disposed at the brush plate of the first cleaning device.

In an embodiment, the automatic cleaning machine further comprises an electric brush. The inlet of the vacuum device is disposed at the base of the housing. The electric brush is disposed at the base and sweeps the dust into the inlet.

In an embodiment, the automatic cleaning machine further comprises at least one sensor disposed at the front or bottom side of the housing and used for detecting an obstacle or a stair.

In an embodiment, the automatic cleaning machine further comprises a bumper and a limit switch. The bumper is disposed at the outer side of the automatic cleaning machine. The limit switch is used to be pushed by the bumper after the bumper hits an obstacle.

In an embodiment, the automatic cleaning machine further comprises a distance measuring sensor used for measuring the distance from the surrounding environment, so as to establish a map for planning a cleaning path.

The various embodiments of the present invention can achieve the following technical improvements. In an embodiment, the automatic cleaning machine comprises a reciprocating wiping mechanism. The wiping frequency of the cleaning cloth is increased, so that a high-efficiency cleaning machine can be obtained. In an embodiment, the automatic cleaning machine comprises a vacuum device, which is capable of sucking up dust and dirt accumulated in front of the cleaning cloth. In an embodiment, the automatic cleaning machine comprises a spray device. The spray device intelligently sprays water to keep the cleaning cloth optimally moisturized, so that a better cleaning effect can be achieved. In an embodiment, the automatic cleaning machine integrates all of the aforementioned devices and is embodied with an artificial intelligence program to enable the machine to clean the floor of the entire room.

BRIEF DESCRIPTION OF THE DRAWINGS

The foregoing features, aspects, and advantages of the present disclosure will now be described with reference to the drawings of preferred embodiments that are intended to illustrate and not to limit the disclosure.

DETAILED DESCRIPTION OF THE INVENTION

These and other embodiments of the present disclosure will also become readily apparent to those skilled in the art from the following detailed description of preferred embodiments having reference to the attached figures; however, the disclosure is not limited to any particular embodiment(s) disclosed herein. Accordingly, the scope of the present disclosure is intended to be defined only by reference to the appended claims.

According to a conventional robot, the floor is wiped by a cleaning cloth pulled by the robot which moves back and forth, so that the number of times that the robot walks through the floor is the number of times that the floor is wiped. According to another conventional robot, the robot only sweeps the floor without spraying water. Accordingly, the conventional robots cannot effectively clean water stain marks, footprints and fine particles. According to an embodiment of the present invention, an automatic cleaning machine is provided which comprises a reciprocately wiping mechanism reciprocately wiping the floor at high speed; and a pair of travel wheels for moving the machine. In an embodiment, the machine further comprises a spray device used for spraying water on a floor. In an embodiment, the machine may further comprise a microprocessor control system and a variety of sensors which detect obstacles and the outline of the environment and plan a cleaning path. The specific structure will be described in detail below.

Figure 1:
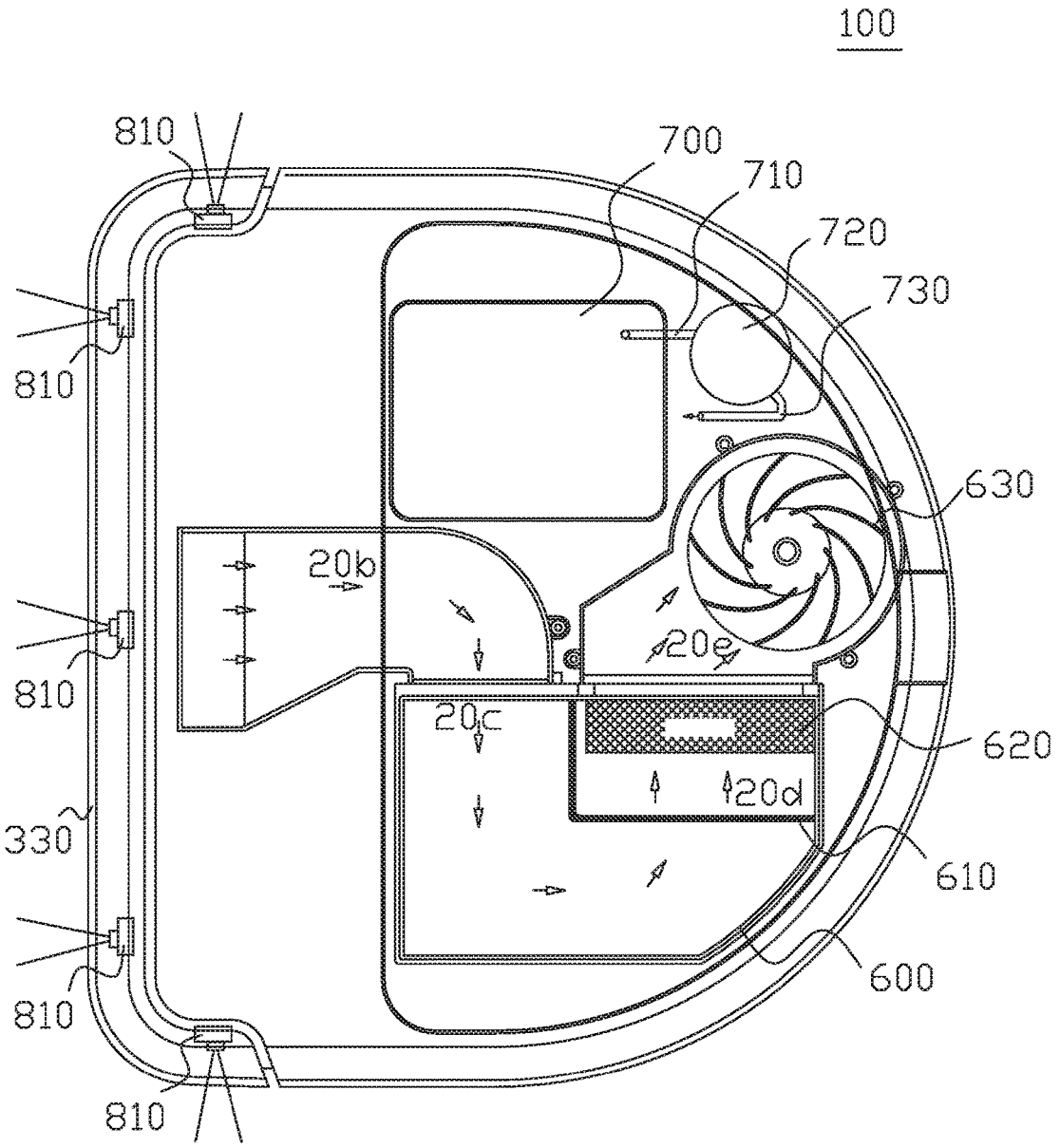
FIG. 1 shows a plan view of an automatic cleaning machine according to an embodiment of the present invention.
Figure 2:
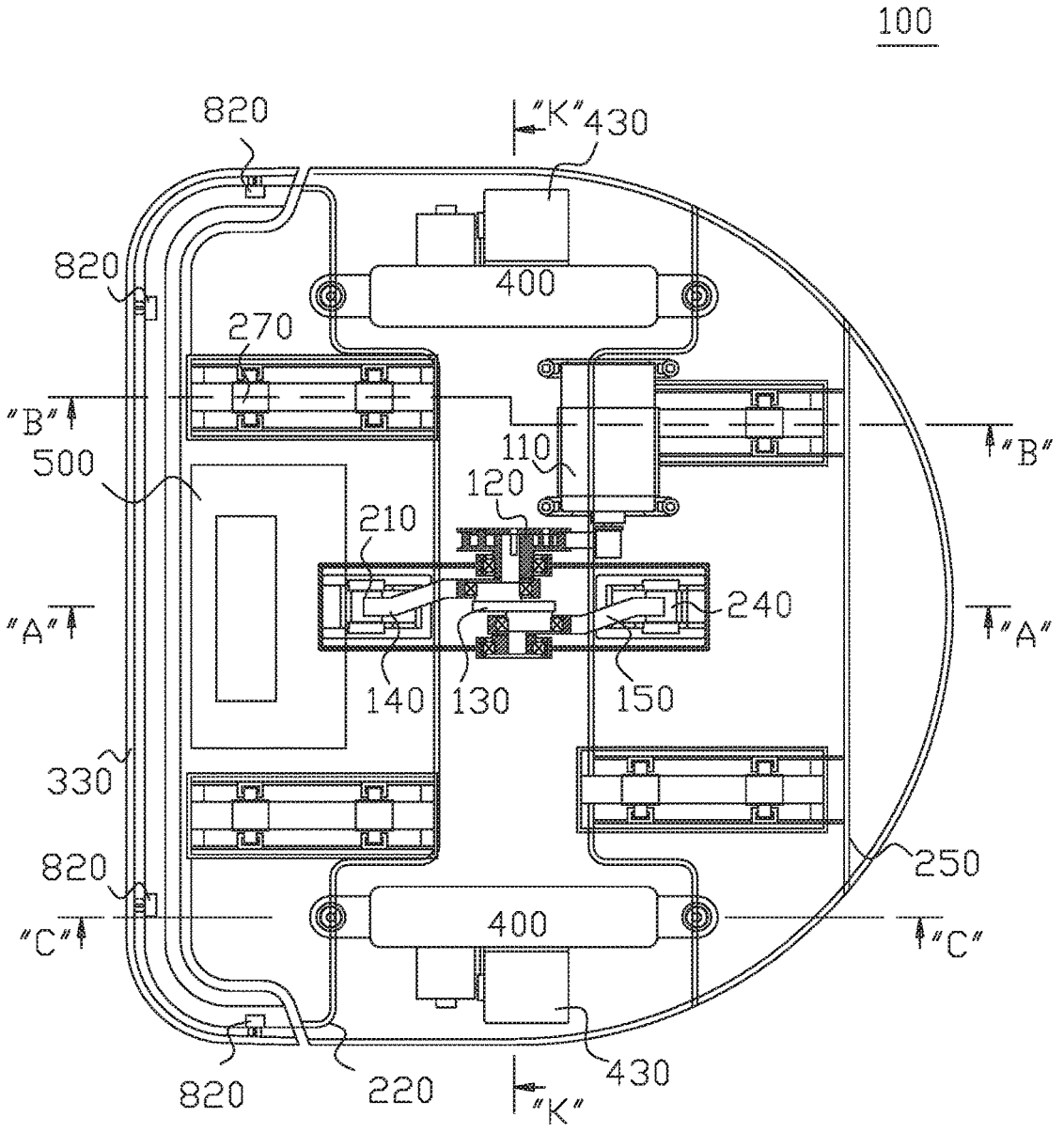
FIG. 2 shows a bottom view of an automatic cleaning machine according to an embodiment of the present invention.
Figure 3:
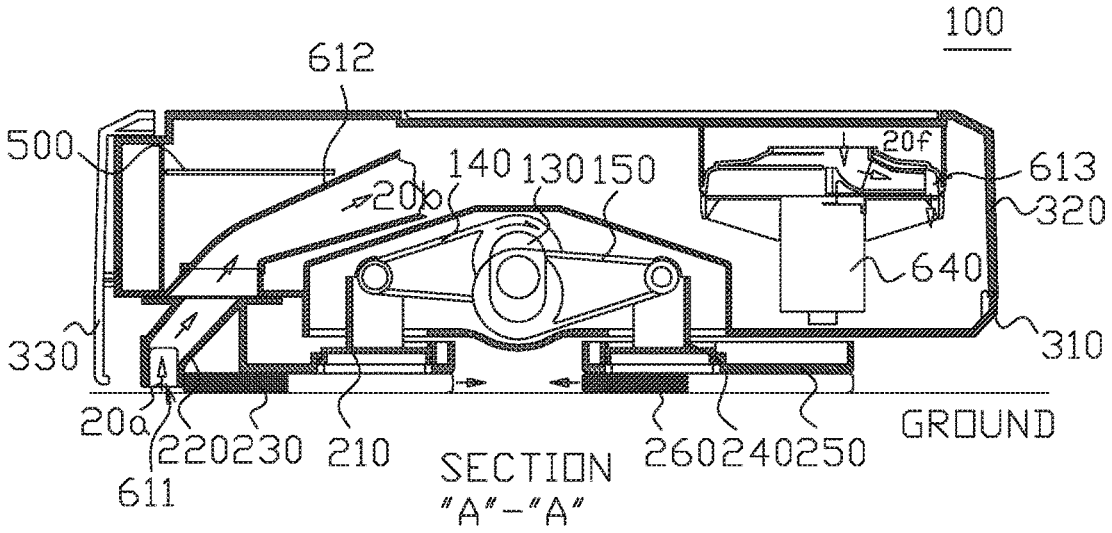
FIG. 3 shows a sectional view of cross-sectional line A-A in FIG. 2.
Figure 4:
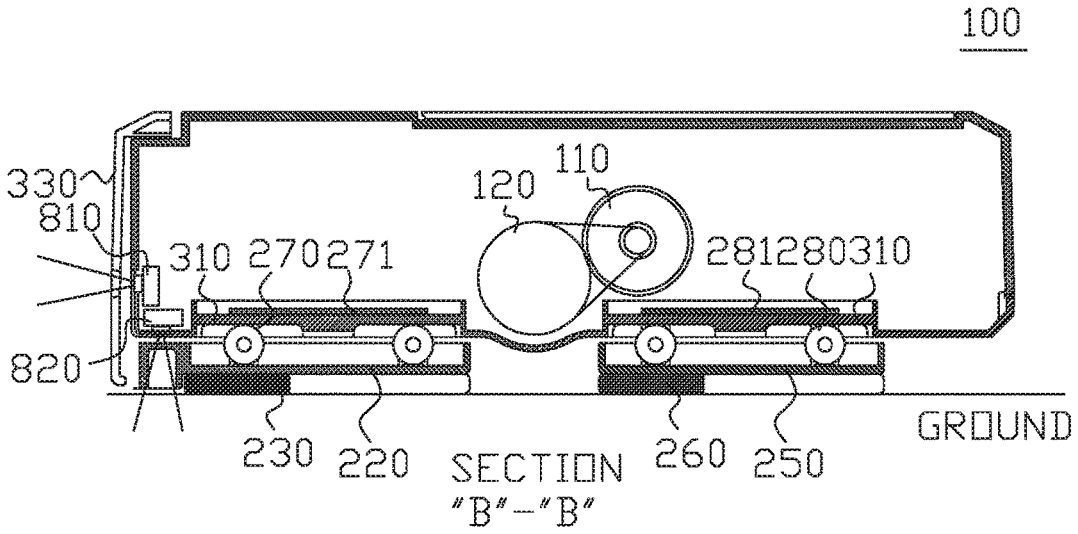
FIG. 4 shows a sectional view of cross-sectional line B-B in FIG. 2.
Figure 5:
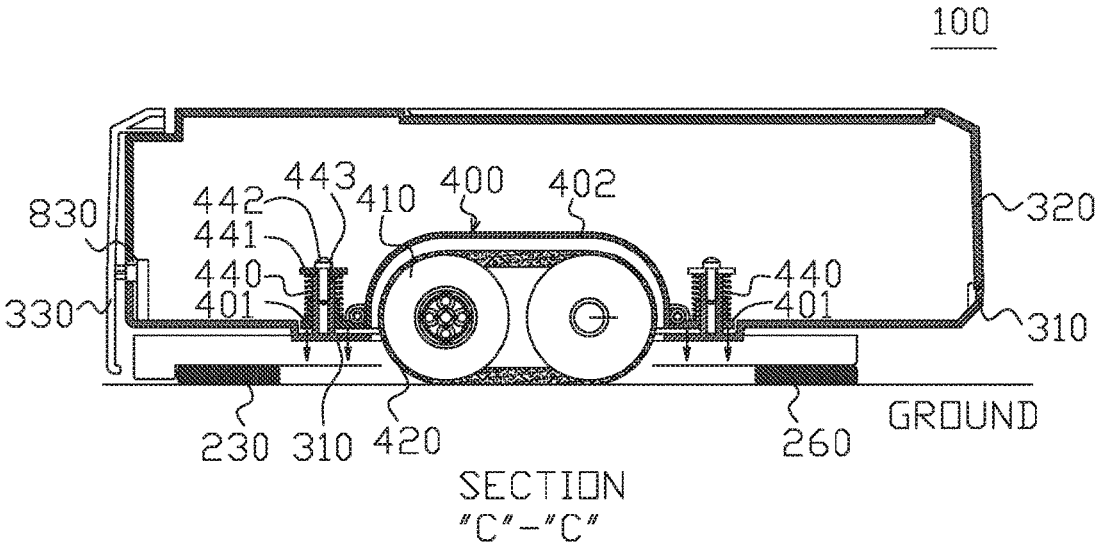
FIG. 5 shows a sectional view of cross-section line C-C in FIG. 2.
Figure 6:
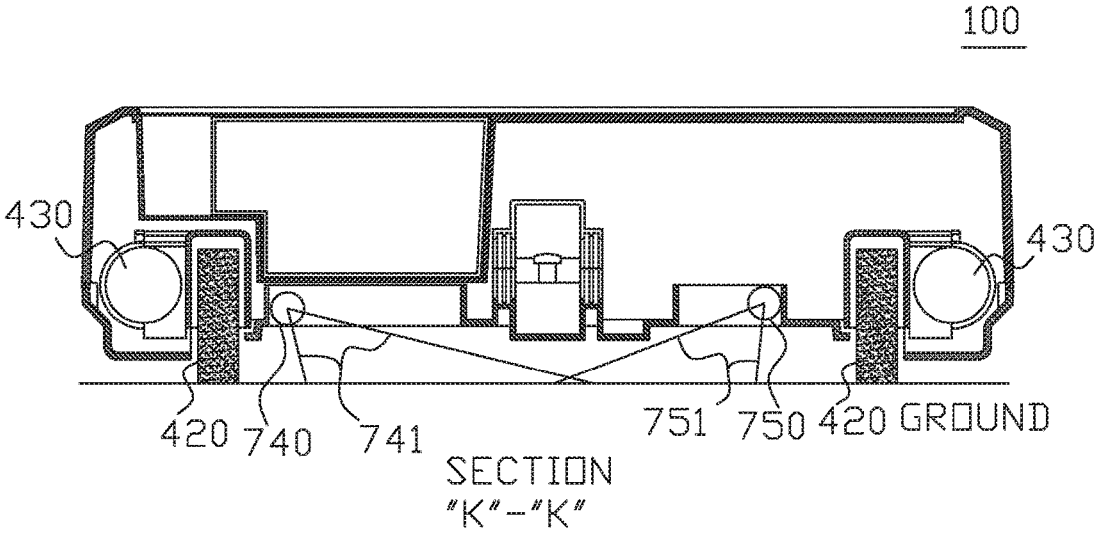
FIG. 6 shows a section view of cross-sectional line K-K in FIG. 2.

FIG. 1 shows a plan view of an automatic cleaning machine according to an embodiment of the present invention. FIG. 2 shows a bottom view of an automatic cleaning machine according to an embodiment of the present invention. FIG. 3 shows a sectional view of cross-sectional line A-A in FIG. 2. FIG. 4 shows a sectional view of cross-sectional line B-B in FIG. 2. FIG. 5 shows a sectional view of cross-section line C-C in FIG. 2. FIG. 6 shows a section view of cross-sectional line K-K in FIG. 2.

Regarding to the reciprocately wiping mechanism. As shown in FIGS. 2-6, the reciprocately wiping mechanism according to an embodiment of the present invention comprises a motor 110, a pulley device 120, a crankshaft 130, at least one crank and at least one cleaning device. In an embodiment, the least one crank comprises two cranks 140 and 150, and two cleaning devices are disposed at the cranks 140 and 150, respectively. As shown in FIG. 4, operation of motor 110 causes the crankshaft 130 to rotate via a pulley bolt of the pulley device 120 as so to slow down the rotation speed of the crankshaft 130. As shown in FIG. 3, the least one crank convert the rotation of the crankshaft 130 to linear reciprocating motion of the least one crank. In this embodiment, the rotation of the crankshaft 130 drive the linear reciprocating motions of the cranks 140 and 150. Preferably, the phase difference between the cranks 140 and 150 is 180°, so that the cleaning devices disposed at the free ends of the cranks 140 and 150 linearly and reciprocately move in opposite directions, respectively.

Please refer to FIG. 3. A front cleaning device comprises a tripod 210, a front brush plate 220 and a cleaning cloth 230. The tripod 210 is connected between the free end of the crank 140 and the front brush plate 220. The cleaning cloth 230 is disposed to or attached to the lower side surface of the front brush disc 220. The free end of the crank 140 pushes the tripod 210, thereby pushing the front brush plate 220, so that the front cleaning cloth 230 attached to the front brush plate 220 reciprocately moves back and forth on the floor. A rear cleaning device comprises a tripod 240, a rear brush plate 250 and a cleaning cloth 260. The tripod 240 is connected between the free end of the crank 150 and the rear brush plate 250. The cleaning cloth 260 is disposed to or attached to the lower side surface of the rear brush disc 250. The free end of the crank 150 pushes the tripod 240, thereby pushing the rear brush plate 250, so that the rear cleaning cloth 260 attached to the rear brush plate 250 reciprocately moves back and forth on the floor.

The front and rear brush plates 220 and 250 appear to be moving in the opposite directions, so that the reaction force can offset each other, and then the automatic cleaning machine 100 can be stably operated. Please refer to FIGS. 2 and 4. The front cleaning device further comprises at least one roller 270, and the front brush plate 220 has two rails. The automatic cleaning machine 100 has a housing 320. The rollers 270 are fixed to the front brush plate 220 and are located between the top surface of the front brush plate 220 and the bottom surface of the base 310 of the housing 320. As shown in FIG. 4, when the front brush plate 220 reciprocately moves back and forth, the roller 270 rotate on the surface of the base 310 or the front brush plate 220 so as to reduce the frictional resistance to the relative motion of the front brush plate 220 and the base 310. In an embodiment, a chute 271 is formed on the upper side of the base 310, and a part of the front brush plate 220 is placed in the chute 271. Accordingly, the front brush plate 220 will not fall down since it is restrained by the chute 271 located above it.

The rear cleaning device further comprises at least one roller 280, and the rear brush plate 250 has two rails. The automatic cleaning machine 100 has a housing 320. The rollers 280 are fixed to the rear brush plate 250 and are located between the top surface of the rear brush plate 250 and the bottom surface of the base 310 of the housing 320. When the rear brush plate 250 reciprocately moves back and forth, the roller 280 rotate on the surface of the base 310 or the rear brush plate 250 so as to reduce the frictional resistance to the relative motion of the rear brush plate 250 and the base 310. In an embodiment, a chute 281 is formed on the upper side of the base 310, and a part of the rear brush plate 250 is placed in the chute 281. Accordingly, the rear brush plate 250 will not fall down since it is restrained by the chute 281 located above it.

The rotational speed of motor 110 can determine the wiping speed of the cleaning cloth 230 and 260 moving back and forth. Preferably, their wiping speed is 100 to 2000 times per minute, which is a high-performance wiping mechanism.

Figure 8:
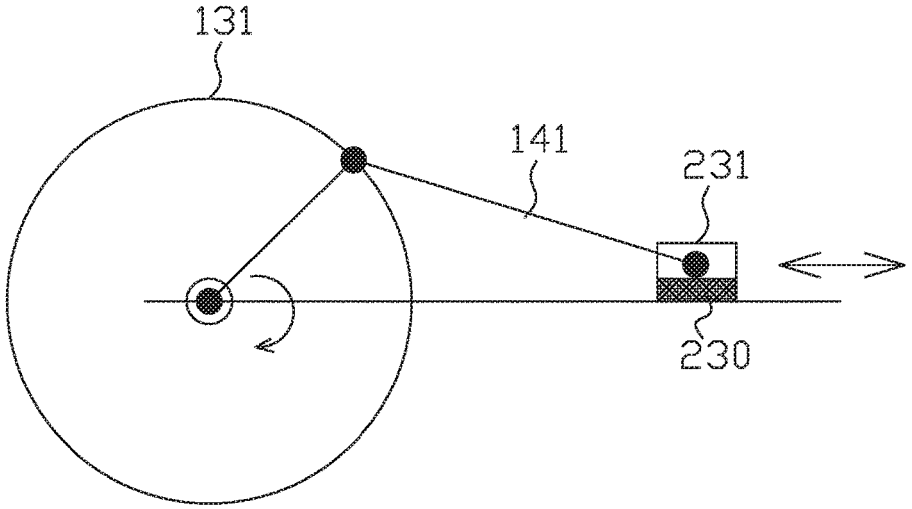
FIG. 8 shows a schematic view of a reciprocating wiping mechanism according to another embodiment of the present invention.

As above, although a reciprocating wiping mechanism in an embodiment is described in detail. However, the present invention is not limited to the aforementioned structure. The reciprocating wiping mechanism can be any structure as long as the structure can convert rotation motion to linear motion. For example, the reciprocating wiping mechanism in an embodiment may comprise a cam and a lever (not shown). The lever abuts on the cam. The cam has a non-circular shape which may be elliptical; or have an end being semi-elliptical and another end being semicircular. When the cam rotates, the lever can move reciprocately and linearly. FIG. 8 shows a schematic view of a reciprocating wiping mechanism according to another embodiment of the present invention, as another example. As shown in FIG. 8, in an embodiment, the reciprocating wiping mechanism comprises a rotating wheel 131, a rod 141 and a cleaning device 231. A clean cloth 230 is disposed on the lower side of the cleaning device 231. When the rotary wheel 131 rotates, it pulls and moves an end of the rod 141, so that the cleaning device 231 connected at another end of the rod 141 move reciprocately and linearly. As a result, the clean cloth 230 can reciprocately wipe a floor.

Regarding to the vacuum device. Although the floor can be cleaned by the linear reciprocating motions of the front and rear brush plates 220 and 250, the dust will be accumulated in front of cleaning cloth 230, that is, at the place near to the movable inlet 611 of the vacuum device in FIG. 2. In an embodiment, an automatic cleaning machine 100 further comprises a vacuum device. The vacuum device comprises a vacuum pump motor 640, an impeller 630 and an air line. The air line comprises a movable inlet 611, a pipe 612, a filter module (610 and 620), a dust bag 600 and an outlet 613. The impeller 630 is rotated by the vacuum pump motor 640 to form an air flow. The air flow sequentially passes through the paths of air flows 20*a* to 20*f* in the air line.

The movable inlet 611 of the vacuum device is located in front of the front edge of the front clean cloth 230. During the operation of the automatic cleaning machine 100, its travelling device moves along a forward direction. The vacuum device sucks dust particles in advance, and then the front clean cloth 230 wipes the portion of the floor where the dust particles located. The movable inlet 611 is located in front of the front edge of the front clean cloth 230 within a predetermined distance. Note that, the vacuum device is capable of sucking up the dust and dirt accumulated in front of the cleaning cloth 230 by use of the air flow 20*a,* so that the dust and dirt cannot be accumulated in front of the cleaning cloth 230. To achieve the objective of not accumulating the dust and dirt, the person having ordinary skill in the art can decide the above-mentioned determined distance on the basis of experiments carried out under different conditions, such as the different efficiencies of the vacuum devices and the different sizes of the movable inlet 611. The determined distance depends on the efficiency of the vacuum device and the size of the movable inlet 611. The higher the efficiency of the vacuum device is, the larger the determined distance is. As shown in FIGS. 1 and 3, the air flow 20*a* enters the inlet 611 near to the front edge of the brush plate 220; the air flow 20*b* passes through the pipe 612. As shown in FIG. 1, the pipe 612 is in communication with the dust bag 600; the air flow 20*c* passes through a primary filter 610 of a filter module; the air flow 20*d* passes through an advanced filter 620 of a filter module. When the air flow 20*d* becomes the air flow 20*e,* most of dirt has been filtered out. Then, the air flow 20*e* becomes the air flow 20*f* which then is discharged from the outlet 613. As a result, the dust on the floor can be sucked away by the vacuum device. In an embodiment, the advanced filter 620 may be a high efficiency particulate air filter (HEPA filter).

Figure 10:
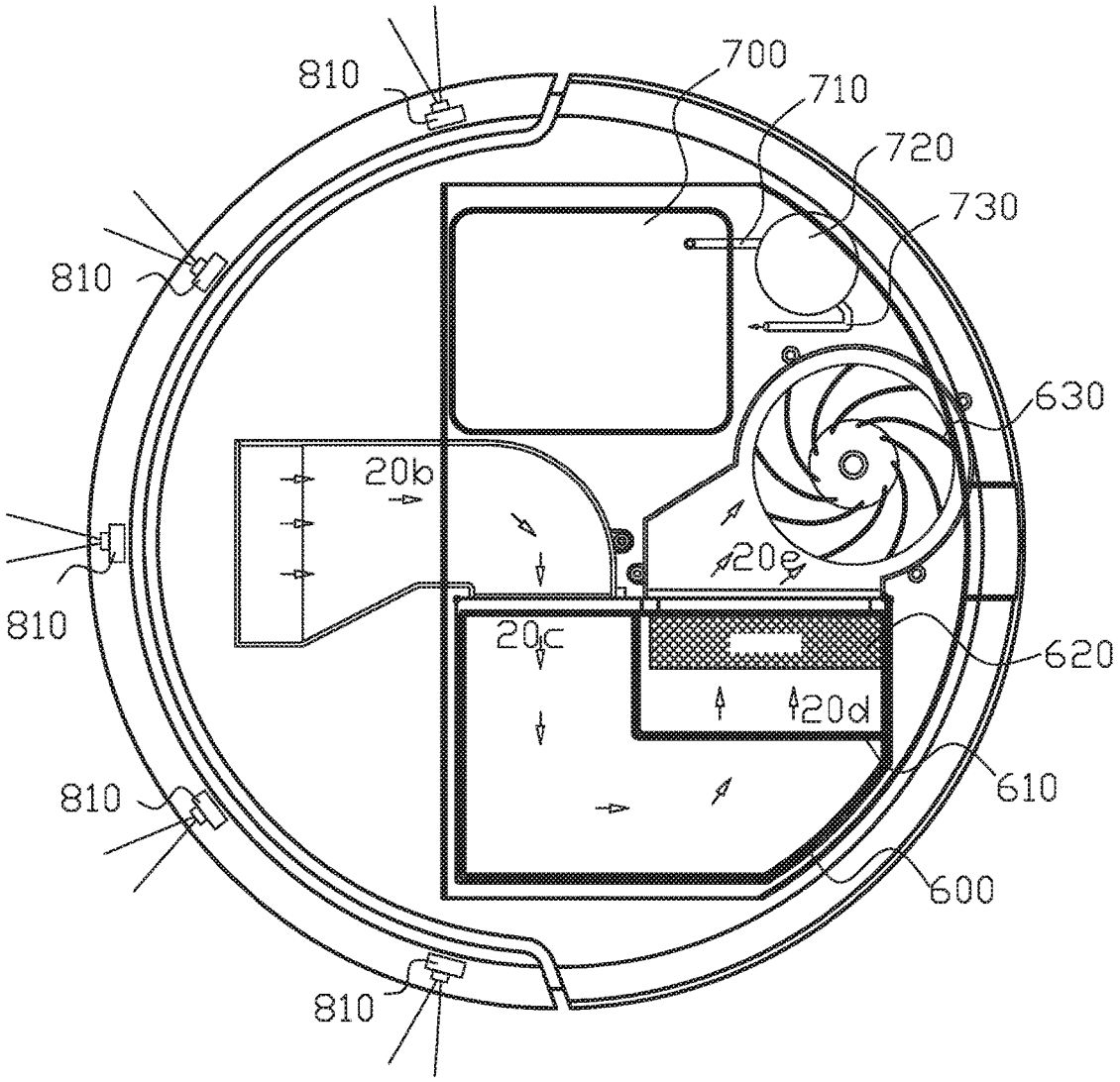
FIG. 10 shows a top view of an automatic cleaning machine according to another embodiment of the present invention.

Regarding to the travelling device. Please refer to FIGS. 2 and 5. According to an embodiment of the present, the automatic cleaning machine 100 comprises two travelling devices each of which comprises a moving wheel module 400 and a case 402. The case 402 is used for accommodating the moving wheel module 400. The moving wheel modules 400 may be a tracked wheel which includes a motor 430, at least one wheel 410 and a track belt 420. In an embodiment, the moving wheel modules 400 may include a wheel and a motor for driving the wheel. The motor 430 includes a reducer which is connected to the wheel 410. The motor 430 drives the wheel 410 and the wheel 410 drives the track belt 420, so that the automatic cleaning machine 100 can travel on the floor. As shown in FIG. 10, the control system 500 comprises a drive circuit connecting to the two motors 430. The control system 500 further comprises a program for controlling the two motors 430, so that the automatic cleaning machine 100 can move left, right, forward and backward. The program may be an artificial intelligent program, which can control the automatic cleaning machine 100 to clean the whole floor (the details are described later).

Regarding to the pressure control structure for the tracked wheel. There are two portions of the automatic cleaning machine 100 that are in contact with the floor; one is the cleaning cloth 230 and the other one is the track belt 420. When the pressure applied to the two above-mentioned portions are not uniform, the automatic cleaning machine 100 cannot normally operate. If the pressure applied to the cleaning cloths 230 and 260 is too large, the pressure applied to the track belt 420 is insufficient and then the track belt 420 will slip and fail to move the machine. On the other hand, if the pressure applied to the track belt 420 is too large, the pressure applied to the cleaning cloths 230 and 260 is insufficient and then the floor cannot be cleaned well. As a result, there is a need to design a pressure control structure which can provide a pressure distribution having a fixed or predetermined proportion, so that the machine can travel properly and wipe the floor cleanly.

As shown in FIG. 5, according to the pressure control structure of an embodiment of the present, the automatic cleaning machine 100 further comprises a spring 440. The spring 440 is disposed between the travelling device and the housing 320 of the automatic cleaning machine 100, so that the spring 440 can push the travelling device in a direction away from the automatic cleaning machine 100, that is, the spring 440 applies downward pressure on the travelling device. Specifically, in this embodiment, the spring 440 is disposed between the moving wheel modules 400 and the base 310, so that it applies downward pressure on the moving wheel modules 400. Accordingly, one can design a constant or predetermined pressure by selecting a spring constant of the spring 440, so as to distribute the pressures applied to the track belt 420 and the cleaning cloths 230 and 260. The pressure control structure for the tracked wheel will be described in detail below. The case 402 of the travelling device comprises a sleeve 401 which is located at one end of the case 402. The housing 320 further includes a fixing column 443, a ring stop 441 and a fixing screw 442. The sleeve 401 is disposed at a protruding end of the case 402 of the moving wheel module 400. Please refer to FIG. 5 again. The fixing column 443 is disposed on the base 310 and projects from the base 310, and the sleeve 401 is sleeved on the outer circumferential surface of the fixing column 443. The ring stop 441 is disposed at the top of the fixing column 443. The fixing screw 442 is screwed into the fixing column 443, so that the ring stop 441 is fixed at the top of the fixing column 443.

The top end of the spring 440 is abutted against the ring stop 441. The bottom end of the spring 440 is abutted against a portion of the case 402 of the travelling device. Specifically, as shown in FIG. 5, it is abutted against the bottom side of the sleeve 401 of the case 402. Therefore, the spring 440 can apply downward pressure on the moving wheel modules 400. In an embodiment, there is no spring for applying downward pressure on the cleaning device, so that the front and rear brush plates 220 and 250 of the cleaning device can smoothly make a linear reciprocating motion.

Figure 9:
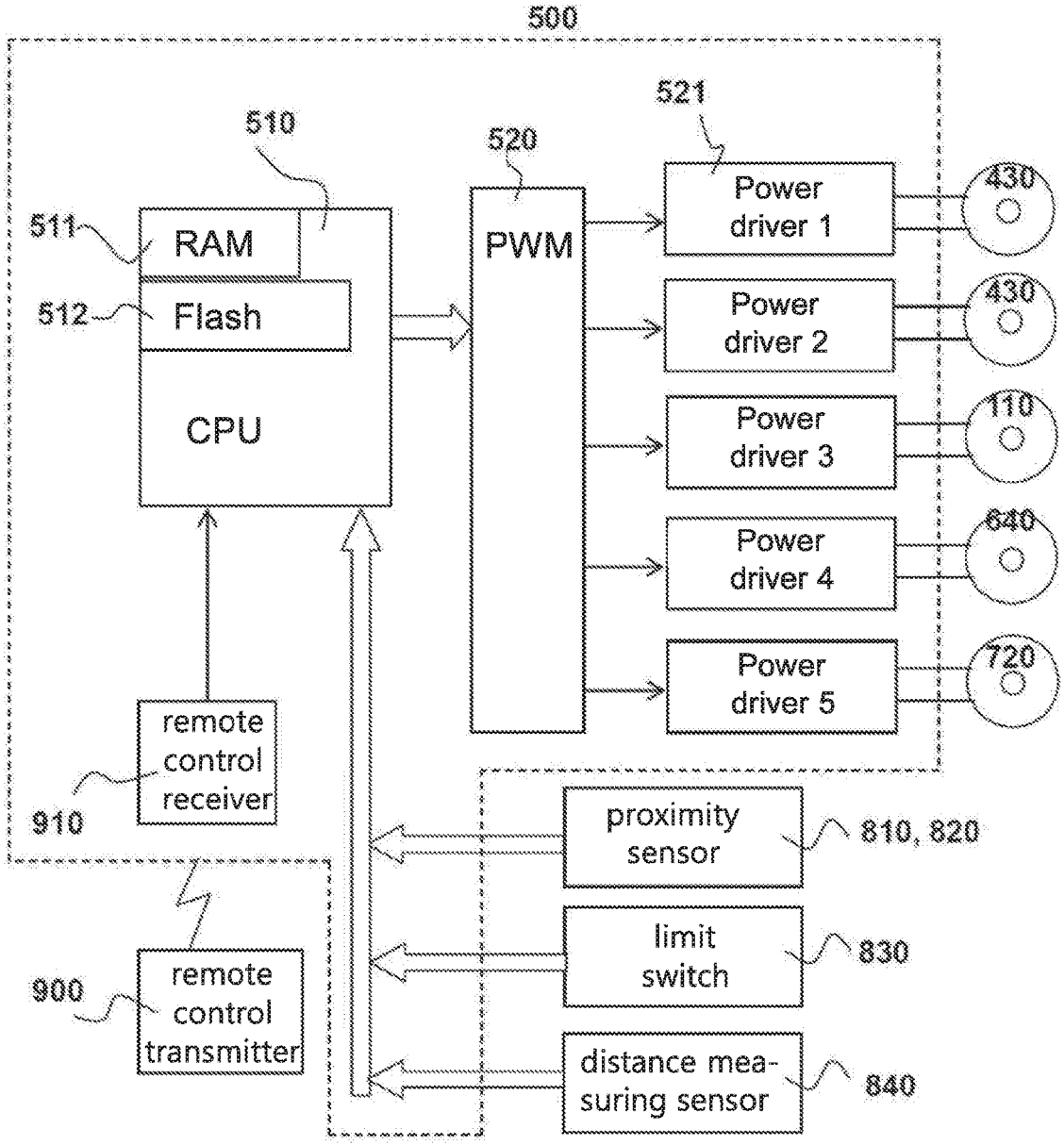
FIG. 9 shows a functional block diagram of a control system according to an embodiment of the present invention.

Regarding to the spray device. According to the conventional art, since a robot dryly wipes the floor, it cannot effectively clean water stain marks, footprints and fine particles. According to an embodiment of the present invention, an automatic cleaning machine 100 further comprises a spray device used for spraying water, so that the stain marks can be cleaned easily. As shown in FIGS. 1 and 6, the spray device comprises a water tank 700, a water pipe 710, a water pump 720, a water pipe 730, a left nozzle 740 and a right nozzle 750. As shown in FIG. 9, the control system 500 can control the water pump 720 to apply pressure on water. As shown in FIG. 1, cleaning water stored in the water tank 700 passes through the water pipe 710 and then reaches to the water pump 720. As shown in FIGS. 1 and 6, the cleaning water is pressurized by the water pump 720, and then left nozzle 740 and the right nozzle 750 shown in FIG. 6 eject the water after the water passes through the water pipe 730. Reference numeral 741 denotes the spraying range of the left nozzle 740, and reference numeral 751 denotes the spraying range of the right nozzle 750. The control system 500 controls the water pump 720 on the basis of the traveling speed of the machine to determine the spraying timing and amount of water, so that the cleaning cloths 230 and 260 is not be too wet or too dry. Accordingly, the automatic cleaning machine 100 can have a better cleaning effect since.

Regarding to the control system. FIG. 9 shows a functional block diagram of a control system according to an embodiment of the present invention. As shown in FIG. 9, the control system 500 comprises a processor (CPU) 510, a memory (RAM) 511, a flash memory 512, a pulse width modulation (PWM) device 520, at least one power driver 521 and a remote control receiver 910. The processor 510, the memory 511 and the flash memory 512 are the basic modules for computing and storing data. An operating software is stored in the flash memory 512, and the operating software controls the pulse width modulating device 520 to output power signals to the power driver 521, thereby driving the motors 430, 110, 640 and 720, respectively. The first and second motors 430 are used for moving the automatic cleaning machine 100. The motor 110 is used for driving the reciprocating wiping operation of the reciprocating wiper mechanism. The vacuum pump motor 640 is used for sucking air, while the water pump motor 640 is used for spraying water.

As shown in FIG. 1, the automatic cleaning machine 100 further includes at least a front proximity sensor 810, which is disposed at a front end of the automatic washing machine 100 and is capable of detecting a front obstacle to avoid impact of the front obstacle. As shown in FIG. 2, the automatic cleaning machine 100 further includes at least a lower proximity sensor 820, which is disposed at the bottom side of the housing 320, preferably, disposed on the bottom surface of the housing 320. The lower proximity sensor 820 may detect whether there a stair in the front of the automatic cleaning machine 100, so as to prevent the automatic cleaning machine 100 from turning over. The proximity sensors 810 and 820 may be an infrared sensor, a laser distance measuring sensor, or an ultrasonic sensor, and other sensors currently available or future developed.

As shown in FIG. 5, in an embodiment, the automatic cleaning machine 100 further includes a bumper 330 and a limit switch 830. The bumper 330 may be provided in front of the automatic washing machine 100. When the bumper 330 hits the obstacle and then pushes the limit switch 830, the microcomputer or processor 510 knows that an obstacle has been encountered and perform other appropriate operations or movements.

In an embodiment, the automatic cleaning machine 100 further includes a distance measuring sensor 840. Accordingly, it can have the function of using laser to measure the distance between it and the obstacle; or the distance between it and the surrounding environment, so as to establish a map for planning a cleaning path.

The program built into the processor 510 of the control system 500 can automatically control all motors, perform obstacle detection, or plan a clean path to clean the entire room.

The control system 500 includes a remote control receiver 910 and a remote control transmitter 900, which may transmit signals by use of wireless technology, such as infrared radiation (IR) or WIFI, or may be other receivers and transmitters currently available or future developed.

Figure 7:
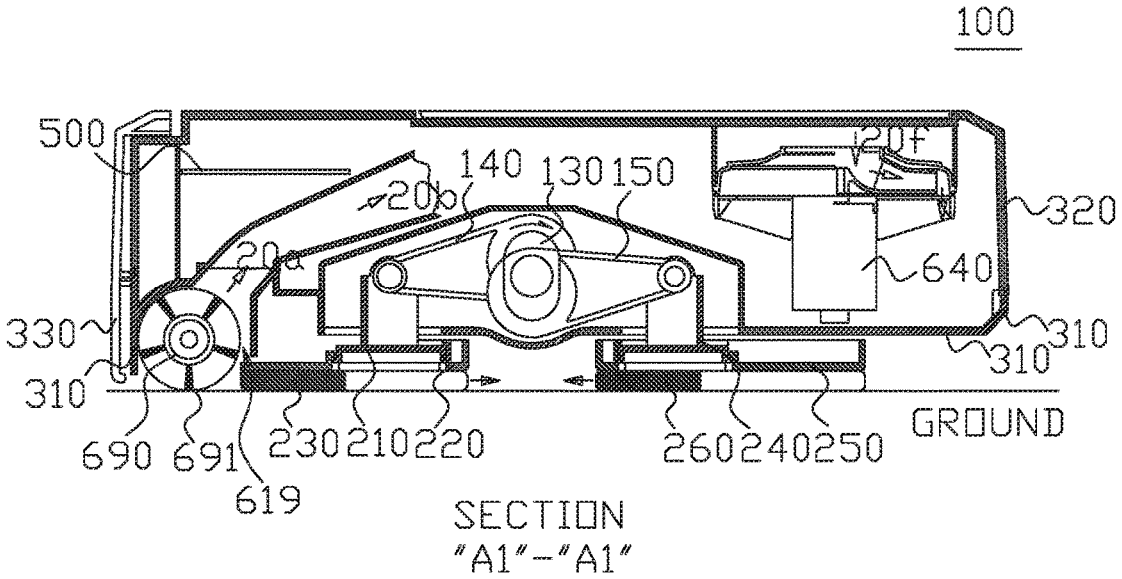
FIG. 7 shows a sectional view of the cross-sectional line corresponding to line A-A in FIG. 2 in an automatic cleaning machine according to an embodiment of the present invention.

FIG. 7 shows a sectional view of the cross-sectional line corresponding to line A-A in FIG. 2 in an automatic cleaning machine according to an embodiment of the present invention. The embodiment of FIG. 7 is similar to the embodiment of FIGS. 2 and 3, and therefore the elements in FIG. 7 having the same function as those in FIGS. 2 and 3 are assigned with the same reference numerals, and redundant explanations thereof are omitted herein. The differences will be described in the following. The cross-sectional line A1-A1 in FIG. 7 corresponds to the cross-sectional line A-A in FIG. 2. As shown in FIG. 7, a fixed inlet 619 is being substituted for the movable inlet 611 of the front brush plate 220. An electric brush 690 near to the fixed inlet 619 is fixed to the base 310. The circular body of the electric brush 690 has spiral bristles 910, which are located near the fixed inlet 619. The electric brush 690 can clean the floor. The dust, hair and trash sweep by the bristles 910 is sucked into the fixed inlet 619 by the air flow 20*a* and then reach to the dust bag 600. Accordingly, the cleaning efficiency of the automatic cleaning machine 100 can be increased.

It should be understood that the invention is not limited to the shape of the automatic the cleaner 100. FIG. 10 shows a top view of an automatic cleaning machine according to another embodiment of the present invention. The embodiment of FIG. 10 is similar to the embodiment of FIG. 1, and therefore the elements in FIG. 10 having the same function as those in FIG. 1 are assigned with the same reference numerals, and redundant explanations thereof are omitted herein. The differences will be described in the following. As shown in FIG. 10, the shape of the automatic the cleaner 100 is circular. In an embodiment, its shape may be triangle (not shown).

According to an embodiment of the present invention, the automatic cleaning machine 100 comprises a high-speed reciprocating wiping mechanism. The wiping frequency of the cleaning cloth 230 can be more than 200 times per minute, so that a high-efficiency cleaning machine can be obtained. In an embodiment, the automatic cleaning machine 100 comprises a vacuum device, which is capable of sucking up the dust and dirt accumulated in front of the cleaning cloth 230. In an embodiment, the automatic cleaning machine 100 comprises a spray device. The spray device intelligently sprays water to keep the cleaning cloth 230 optimally moisturized, so that a better cleaning effect can be achieved. According to an embodiment of the present invention, the automatic cleaning machine 100 integrates all of the aforementioned devices and is embodied with an artificial intelligence program to enable the machine to clean the floor of the entire room.

These and other embodiments of the present disclosure become readily apparent to those skilled in the art from the above detailed description of preferred embodiments having reference to the attached figures; however, the disclosure is not limited to any particular embodiment(s) disclosed herein. These and other modifications of this invention, which would be obvious to those skilled in the art, are included within the scope of this invention and the terms of the following claims.

The invention claimed is:

1. An automatic cleaning machine, comprising:
- a reciprocately wiping mechanism comprising:
  - at least one cleaning device used for being in contact with a floor; and
  - at least one reciprocating device connected to the at least one cleaning device and making the at least one cleaning device reciprocately wipe the floor; and
- a travelling device used to make the automatic cleaning machine travel on the floor;
- a control system coupled to the reciprocately wiping mechanism and the travelling device and used to control the reciprocately wiping mechanism and the travelling device, wherein the at least one reciprocating device comprises:
- a motor;
- a crankshaft, driven by the motor to rotate;
- at least one crank, wherein an end of the at least one crank is connected to the crankshaft, and wherein another end of the at least one crank is connected to a brush plate of the at least one cleaning device and then reciprocately moves as the crankshaft rotates.

2. The automatic cleaning machine according to claim 1, wherein
- the at least one cleaning device comprises a first cleaning device and a second cleaning device, and
- the at least one reciprocating device used to make the first cleaning device move in a first direction and make the second cleaning device move in a second direction opposite to the first direction.

3. The automatic cleaning machine according to claim 1, further comprising a housing, wherein,
- the housing is used for accommodating the at least one reciprocating device of the reciprocately wiping mechanism, the control system and the travelling device, and
- the at least one cleaning device comprises:
  - a brush plate disposed below a base of the housing;
  - a roller located between the brush plate and the housing, and rotates on the brush plate or the base, so as to reduce the frictional resistance to the relative motion of the brush plate and the base; and
  - a cleaning cloth disposed at the brush plate and used to be in contact with the floor.

4. The automatic cleaning machine according to claim 3, further comprising a vacuum device, wherein,
- the vacuum device comprises an inlet, wherein the dust on the floor is sucked into the inlet by an air flow,
- the at least one cleaning device comprises a first cleaning device, and
- the inlet is disposed in front of the first cleaning device within a predetermined distance from the first cleaning device, wherein within the predetermined distance, the dust is not accumulated.

5. The automatic cleaning machine according to claim 4, wherein the inlet of the vacuum device is disposed at the brush plate of the first cleaning device.

6. The automatic cleaning machine according to claim 4, further comprising an electric brush, wherein
- the inlet of the vacuum device is disposed at the base of the housing, and
- the electric brush is disposed at the base and sweeps the dust into the inlet.

7. The automatic cleaning machine according to claim 1, further comprising a housing and an elastic element, wherein, the housing is used for accommodating the at least one reciprocating device of the reciprocately wiping mechanism, the control system and the travelling device, and the elastic element is disposed between the travelling device and the housing, so that the elastic element is capable of pushing the travelling device in a direction away from the automatic cleaning machine.

8. The automatic cleaning machine according to claim 7, wherein, the travelling device comprises a moving wheel module; and a case accommodating the moving wheel module and including a sleeve, the housing comprises:

a base;

a fixing column disposed on the base and projecting from the base, wherein the sleeve is sleeved on the outer circumferential surface of the fixing column;

a ring stop disposed at a top side of the fixing column; and a fixing screw screwed into the fixing column, so that the ring stop is fixed at the top side of the fixing column, and an end of the elastic element is abutted against the ring stop, and another end of the elastic element is abutted against a portion of the case of the travelling device.

9. The automatic cleaning machine according to claim 1, further comprising a vacuum device, wherein, the vacuum device comprises an inlet, wherein the dust on the floor is sucked into the inlet by an air flow, the at least one cleaning device comprises a first cleaning device, and the inlet is disposed in front of the first cleaning device within a predetermined distance from the first cleaning device, wherein within the predetermined distance, the dust is not accumulated.

10. The automatic cleaning machine according to claim 1, further comprising a spray device used for spraying water on the floor.

11. The automatic cleaning machine according to claim 1, further comprising at least one sensor disposed at the front or bottom side of the housing and used for detecting an obstacle or a stair.

12. The automatic cleaning machine according to claim 1, further comprising:

a bumper disposed at the outer side of the automatic cleaning machine; and a limit switch used to be pushed by the bumper after the bumper hits an obstacle.

13. The automatic cleaning machine according to claim 1, further comprising a distance measuring sensor used for measuring the distance from the surrounding environment, so as to establish a map for planning a cleaning path.

14. The automatic cleaning machine according to claim 1, wherein the travelling device comprises a tracked wheel, the tracked wheel comprises a wheel motor, a first wheel and a track belt, the track belt is suitable for being in contact with the floor, and the wheel motor drives the first wheel and the first wheel drives the track belt, so that the automatic cleaning machine can travel on the floor.

15. The automatic cleaning machine according to claim 14, further comprising a housing and an elastic element, wherein, the housing is used for accommodating the at least one reciprocating device of the reciprocately wiping mechanism, the control system and the travelling device, and the elastic element is disposed between the tracked wheel of the travelling device and the housing, so that the elastic element is capable of distributing the pressures applied to the track belt and the at least one cleaning device.

16. The automatic cleaning machine according to claim 14, further comprising a housing and an elastic element, wherein, the tracked wheel further comprises a second wheel, the first and second wheels are disposed at the inside surface of the track belt, and disposed at the two ends of the track belt, and the two points at which the first and second wheels contact with the floor via the track belt are spaced a predetermined distance.

17. An automatic cleaning machine, comprising:

a reciprocately wiping mechanism comprising:

at least one cleaning device used for being in contact with a floor; and at least one reciprocating device connected to the at least one cleaning device and making the at least one cleaning device reciprocately wipe the floor; and a travelling device used to make the automatic cleaning machine travel on the floor;

a control system coupled to the reciprocately wiping mechanism and the travelling device and used to control the reciprocately wiping mechanism and the travelling device, a housing, wherein, the housing is used for accommodating the at least one reciprocating device of the reciprocately wiping mechanism, the control system and the travelling device, and the at least one cleaning device comprises:

a brush plate disposed below a base of the housing;

a roller located between the brush plate and the housing, and rotates on the brush plate or the base, so as to reduce the frictional resistance to the relative motion of the brush plate and the base; and a cleaning cloth disposed at the brush plate and used to be in contact with the floor.

18. The automatic cleaning machine according to claim 17, wherein the at least one cleaning device comprises a first cleaning device and a second cleaning device, and the at least one reciprocating device used to make the first cleaning device move in a first direction and make the second cleaning device move in a second direction opposite to the first direction.

19. The automatic cleaning machine according to claim 17, further comprising a vacuum device, wherein, the vacuum device comprises a inlet, wherein the dust on the floor is sucked into the inlet by an air flow, the at least one cleaning device comprises a first cleaning device, and the inlet is disposed in front of the first cleaning device within a predetermined distance from the first cleaning device, wherein within the predetermined distance, the dust is not accumulated.

20. The automatic cleaning machine according to claim 19, wherein the inlet of the vacuum device is disposed at the brush plate of the first cleaning device.

21. The automatic cleaning machine according to claim 19, further comprising an electric brush, wherein the inlet of the vacuum device is disposed at the base of the housing, and the electric brush is disposed at the base and sweeps the dust into the inlet.

22. An automatic cleaning machine, comprising:

a reciprocately wiping mechanism comprising:

at least one cleaning device used for being in contact with a floor; and at least one reciprocating device connected to the at least one cleaning device and making the at least one cleaning device reciprocately wipe the floor; and a travelling device used to make the automatic cleaning machine travel on the floor;

a control system coupled to the reciprocately wiping mechanism and the travelling device and used to control the reciprocately wiping mechanism and the travelling device, and wherein the travelling device comprises a tracked wheel, the tracked wheel comprises a wheel motor, a first wheel and a track belt, the track belt is suitable for being in contact with the floor.

the wheel motor drives the first wheel, and the first wheel drives the track belt, so that the automatic cleaning machine can travel on the floor.

23. The automatic cleaning machine according to claim 22, further comprising a housing and an elastic element, wherein, the housing is used for accommodating the at least one reciprocating device of the reciprocately wiping mechanism, the control system and the travelling device, and the elastic element is disposed between the tracked wheel of the travelling device and the housing, so that the elastic element is capable of distributing the pressures applied to the track belt and the at least one cleaning device.

24. The automatic cleaning machine according to claim 22, further comprising a housing and an elastic element, wherein, the tracked wheel further comprises a second wheel, the first and second wheels are disposed at the inside surface of the track belt, and disposed at the two ends of the track belt, and the two points at which the first and second wheels contact with the floor via the track belt are spaced a predetermined distance.

* * * * *